US008967065B2

(12) United States Patent
Barton

(10) Patent No.: US 8,967,065 B2
(45) Date of Patent: Mar. 3, 2015

(54) BAILER

(71) Applicant: Epic Kayaks, Inc., Charleston, SC (US)

(72) Inventor: Gregory Barton, Seattle, WA (US)

(73) Assignee: Epic Kayaks, Inc., Charleston, SC (US)

( * ) Notice: Subject to any disclaimer, the term of this patent is extended or adjusted under 35 U.S.C. 154(b) by 138 days.

(21) Appl. No.: 13/796,917

(22) Filed: Mar. 12, 2013

(65) Prior Publication Data

US 2013/0269581 A1 Oct. 17, 2013

Related U.S. Application Data

(60) Provisional application No. 61/620,080, filed on Apr. 16, 2012.

(51) Int. Cl.
*B63B 13/00* (2006.01)

(52) U.S. Cl.
CPC ..... *B63B 13/00* (2013.01)
USPC ..... 114/183 R

(58) Field of Classification Search
USPC ..... 114/183 R
IPC ..... B63B 13/00
See application file for complete search history.

(56) References Cited

U.S. PATENT DOCUMENTS

| | | | | |
|---|---|---|---|---|
| 1,070,364 A | | 8/1913 | Voight | |
| 5,083,521 A | | 1/1992 | Widing | |
| 5,522,338 A | | 6/1996 | Eilert et al. | |
| 5,605,176 A | * | 2/1997 | Herzberger | 137/556 |
| 5,785,362 A | | 7/1998 | Nadherny | |
| 5,937,473 A | * | 8/1999 | Lisowski | 15/236.08 |
| 6,338,309 B1 | | 1/2002 | Michelson | |
| 2010/0237665 A1 | | 9/2010 | Grace | |

FOREIGN PATENT DOCUMENTS

GB 1522635 A 8/1978

OTHER PUBLICATIONS

International Search Report and Written Opinion for corresponding PCT Application No. PCT/US2013/030654, dated May 28, 2013.

Rig-Rite, Inc, Elvstrom bailers and parts, rig-rite. com. May 2013. (retrieved on May 2, 2013) 1-25 retreived from the internet<URL: http://www.rigrite.com/Hardware/Bailers/Elvstrom_Bailers.html>.

Britton Reynolds Ward, "The Hydrodynamics of Sailboat Bailing Devices" Massachusetts Institute of Technology, B.S. Naval Architecture and Marine Engineering, 111 pages, Sep. 1996.

* cited by examiner

*Primary Examiner* — Stephen Avila
(74) *Attorney, Agent, or Firm* — Timothy X. Gibson, Esq.; Gibson & Dernier LLP

(57) ABSTRACT

A bailer for a watercraft which is open on two sides, i.e., the rear and one adjoining side, enabling more efficient drainage of water from a watercraft. An adjustable bailer is provided which may include a handle with indexed positions which allows the user to easily adjust how far the bailer is open to suit conditions. The handle can be operated by either the hand or foot. The indexing function enables a user to judge how far the bailer is open or closed.

25 Claims, 14 Drawing Sheets

BAILER

CROSS REFERENCE TO RELATED APPLICATIONS

This application claims the benefit of U.S. Provisional Patent Application No. 61/620,080, filed Apr. 16, 2012, the entirety of which is incorporated by reference herein.

FIELD OF THE INVENTION

The present subject matter is directed to bailers for watercraft, and more particularly to an automatic bailer for canoes, kayaks and other watercraft.

BACKGROUND

So called Elvstrom-type bailers (produced by Andersen and others) are commonly employed in sailboats. Such bailers are fixed in an aperture formed in a boat bottom, and employ a wedge-shaped venturi having an opening facing the rear of the boat on the outside of the boat hull to permit outflow of water at high speed forward travel. The flow of deflected water draws water from inside the boat as long as the boat is moving through the water at a fairly rapid speed. A flap, open during rapid speed travel, acts as a non-return valve, closing when the boat is stationary in the water or moving too slowly for outflow. The bailer can be closed so that it is flush with the surface of the hull, completely sealing it from incoming water and eliminating drag from the bailer.

A drawback in existing Elvstrom-type bailers is that there is limited area from which water can drain. Water can only drain from the gated portion at the back of the wedge, which is about 50% of the rear vertical surface.

Another drawback in such bailers is that they cannot be easily adjusted to different levels. Such bailers are typically used in either the fully open position—allowing water drainage while inducing a significant amount of drag on the boat, or fully closed—eliminating the extra drag, but allowing no drainage. The bailers must be opened at least 50% to allow the gate to open and draining to begin. Between 50% and 100% open, it is very difficult to judge how far the bailer is open, thus making it impractical to adjust the amount of bailing needed.

Thus there is a need for a bailer which provides a higher ratio of draining speed (bailing) to induced drag, and which is adjustable at various levels to vary the draining rate and induced drag.

SUMMARY OF THE INVENTION

Bailers are disclosed which provide significantly more area for flow and are operable to drain much faster than conventional bailers. The disclosed bailers increase the ratio of draining speed to induced drag over prior art bailers. The disclosed bailers are also adjustable at various levels to vary the draining rate and induced drag.

In accordance with one embodiment, the presently disclosed subject matter is directed to an automatic bailer open on three sides, i.e., the rear and adjoining sides.

In another embodiment a bailer is provided which is open on two sides, i.e., the rear and one adjoining side.

In accordance with one embodiment, an adjustable bailer is provided which may include a handle with indexed positions (roughly ¼, ½, ¾ and fully open) which allows the user to easily adjust how far the bailer is open to suit conditions. The full open position will drain the fastest, but also create the most drag. It can be set at one of the other positions to give only as much bailing as needed while minimizing drag. It can also be fully closed to give no drag and prevent leakage back into the cockpit. The handle can easily be operated by either the hand or foot. The indexing function makes it easier for a user to judge how far the bailer is open compared to prior art bailers In accordance with one aspect a bailer is provided which is operable to be mounted to the hull of a kayak, canoe or other small watercraft.

In accordance with another embodiment a bailer is provided which is operable to be mounted in the footwell of a kayak or canoe. The bailer may be adjusted by a user's foot. Placement of the bailer in a footwell or bulkheaded compartment that only holds a couple liters of water when flooded to the outside water level is advantageous.

In another embodiment the device is constructed of plastic with rounded corners to provide a safer alternative to conventional bailers, eliminating potential cuts from the sharp metal corners and rough edges of conventional metal bailers.

In accordance with an embodiment, a bailer for a watercraft includes a frame having an opening formed therein, an open-sided flap having an end pivotably connected to the frame, the flap operable to move pivotably from a closed position covering the opening to an open position away from the opening, and a handle operably connected to the frame and operable to activate opening and closing of the flap. The frame may be configured to mount in an aperture formed in the bottom of a watercraft. The frame may include a support extending therefrom, wherein the handle is pivotably connected to the support at a point between the ends of the handle and is operable to move the flap between open and closed positions.

In an embodiment the flap includes a first side having a web extending vertically therefrom, the web having a slot formed therein and at least one detent formed on a side of the web. The flap may have a second, substantially flat opposite side. The slot is configured to accommodate a drive pin operably connected to an end of the handle, wherein the drive pin is slidably engaged in the slot. The handle may include opposing connecting bars configured to pivotably engage a support extending from the frame, and the drive pin spanning between the connecting bars. One or more tabs may be positioned on an inside surface of at least one of the connecting bars and are operable to engage the at least one detent. One or more arms may be positioned on an outside surface of at least one connecting bar, wherein the cam arm is operable to contact the frame.

In accordance with a further embodiment, a bailer in accordance with the present disclosure may include at least one support extending vertically from a first side of the frame and extending longitudinally along the frame, the at least one support including an aperture formed longitudinally along a portion of the length of the at least one support. In this embodiment the handle may include a pin slidably engaged to the aperture of the support, and be operable to slide longitudinally along the at least one support and move the flap between open and closed positions. The sliding handle may be generally U-shaped and configured to "saddle" the support. A first end of the flap is pivotably connected to the frame, and includes a first side having a web extending vertically therefrom, the web having a slot configured to accommodate the pin of the handle.

Bailers in accordance with the present disclosure may include a handle whereby the position of the handle is operable to provide to a user a visual cue identifying the position of the bailer flap. The handle may also be operable to provide to a user a tactile indicator of the position of the bailer flap. Indicia may be positioned on the surface of the frame operable to provide to a user a visual cue identifying the position of the bailer flap.

The handle may include a grip extending from one end of the handle.

In accordance with a further embodiment a bailer for a watercraft is disclosed having a frame including an opening formed therein, a flap having an end pivotably connected to the frame, the flap operable to move pivotably from a closed position covering the opening to an open position away from the opening, and a handle operably connected to the frame and operable to activate opening and closing of the flap, the frame having a support extending therefrom, wherein the handle is operable to move the flap between open and closed positions, wherein the position of the handle is operable to provide to a user at least one of a visual cue identifying the position of the bailer flap and a tactile indicator of the position of the bailer flap. The bailer may include indicia operable to provide the visual cue identifying the position of the bailer flap. The bailer may include a detent and a complementary tab operable to engage the detent to provide the tactile indicator.

Watercrafts employing the disclosed bailers provide an effective means for emptying the craft of on-board water without the necessity of hand bailing. Bailers in accordance with the present disclosure are particularly well suited to sit-on-top boats, including surf skis and one & two man outrigger canoes (OC-1/OC-2).

BRIEF DESCRIPTION OF THE DRAWINGS

For the purposes of illustration, there are forms shown in the drawings that are presently preferred, it being understood, however, that the invention is not limited to the precise arrangements and instrumentalities shown.

DETAILED DESCRIPTION OF THE PRESENT INVENTION

The following is a detailed description of the subject matter provided to aid those skilled in the art in practicing the present invention. Those of ordinary skill in the art may make modifications and variations in the embodiments described herein without departing from the spirit or scope of the present invention. Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. All publications, patent applications, patents, figures and other references mentioned herein are expressly incorporated by reference in their entirety.

Figure 1:
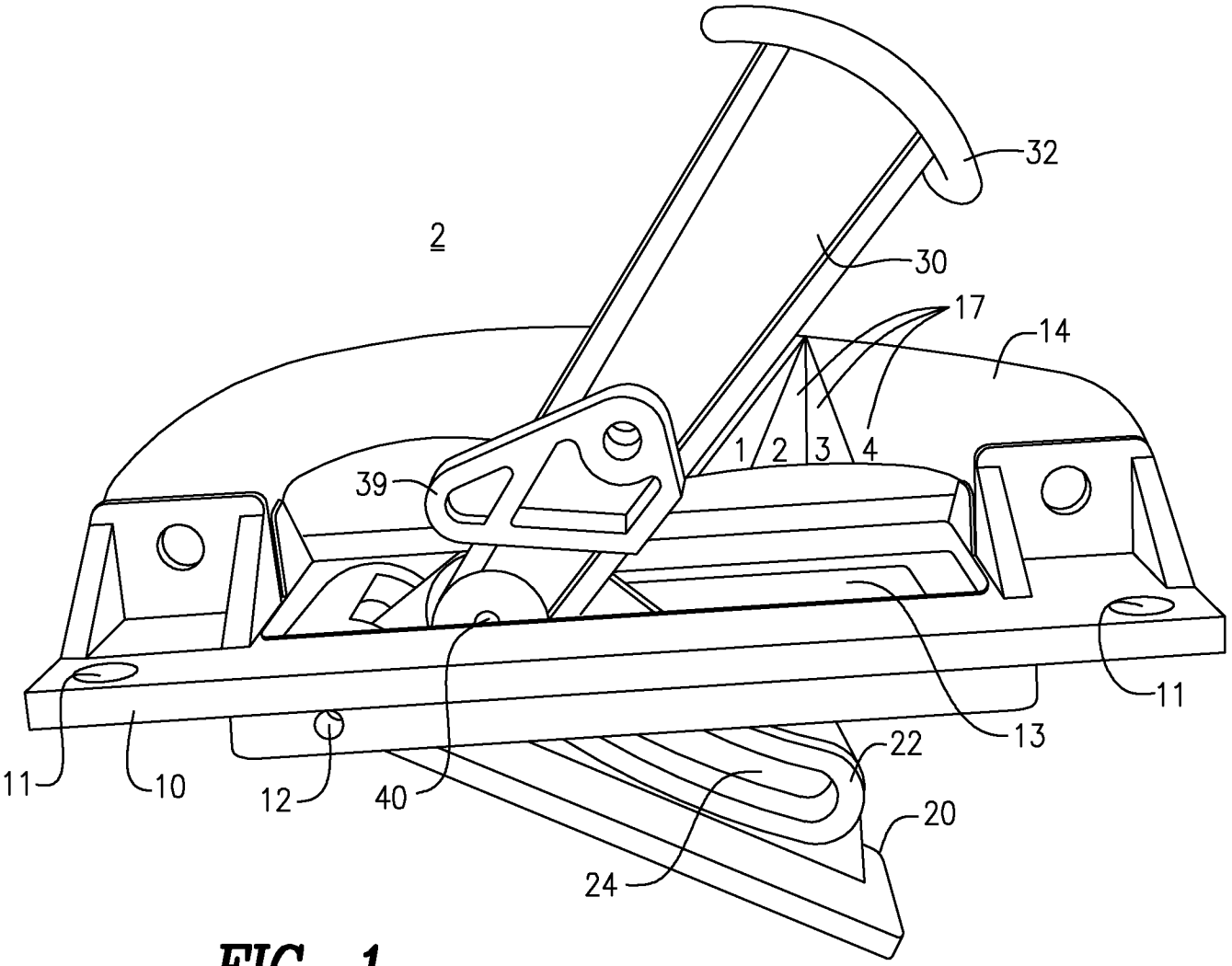
FIG. 1 is a side view of a bailer in accordance with one aspect of the present disclosure.

With reference to FIG. 1, in accordance with one embodiment a bailer 2 includes a frame 10 having an opening 13, flap 20 and handle 30. Flap 20 is pivotably connected to frame 10 permitting flap 20 to rotate from a closed position, covering opening 13, to an open position. Frame 10 further supports handle 30 which is operable to activate opening and closing of the bailer 2.

Figure 2:
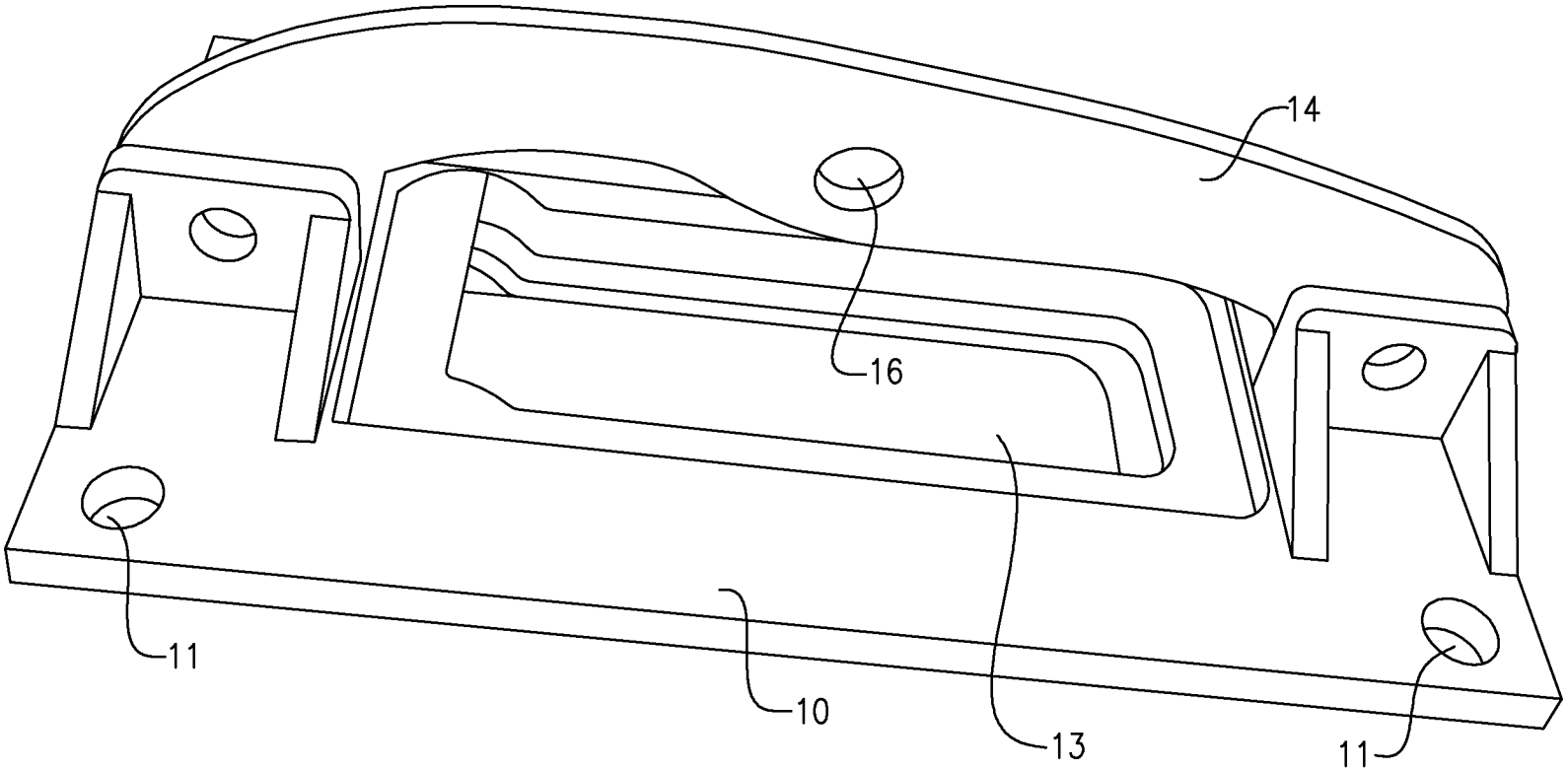
FIG. 2 is a perspective view of a frame of a bailer in accordance with an aspect of the present disclosure.

Now further referring to FIG. 2, in general the frame 10 is fastenable to a surface of boat so that bailer 2 is operably connected to a boat. Frame 10 is configured to mount in an aperture formed in the bottom of a watercraft, such as a kayak, employing any suitable mounting means such as but not limited to screws, rivets, bolts, and/or adhesive. The frame 10 may include apertures 11 formed therein for receiving mounting means. The frame 10 may include a hinge assembly or region 12 disposed proximate the opening 13, the hinge assembly 12 configured to pivotably engage flap 20 such as via a hinge pin (not shown) or the like. The engagement of the flap 20 to the frame 10 enables the flap 20 to pivot down and drain the boat. In one embodiment, a gasket (not shown) is positioned on the frame 10 around the opening 13 to provide a sealing surface against the flap 20 to prevent water from leaking into the boat when the flap is closed against the frame 10. Frame 10 may include a support 14 which spans lengthwise across the frame 10. An opening 16 in support 14 is configured to receive a pin which serves as a connection and pivot point for the handle 30. Opening 16 may include or be configured to receive a bushing operable to receive the pivot pin.

Figure 3:
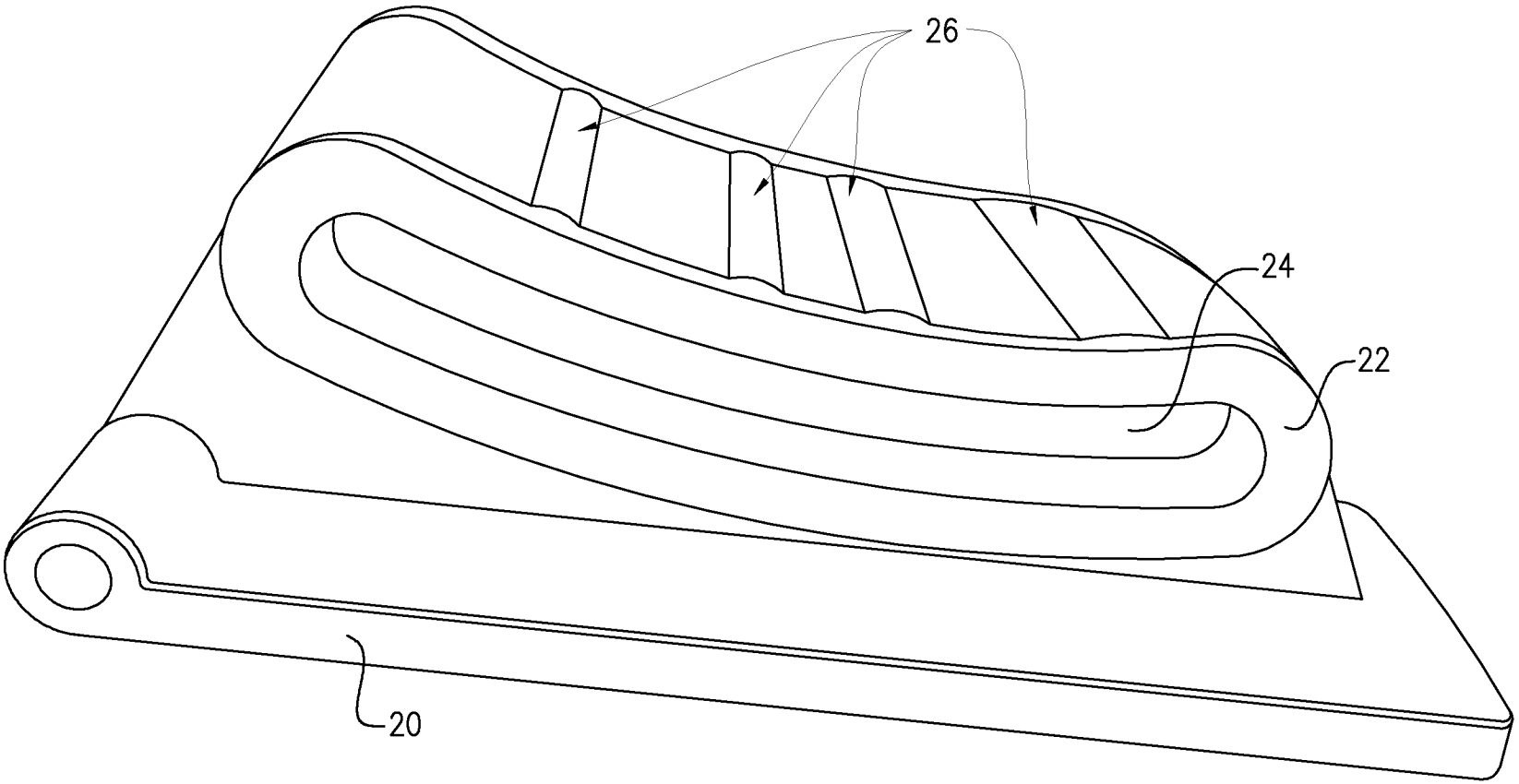
FIG. 3 is a side perspective view of a flap of a bailer in accordance with an aspect of the present disclosure.

With further reference to FIG. 3, flap 20 is pivotably connected to frame 10 at a hinge 12. When the bailer 2 is installed in the boat, the hinge 12 is positioned proximal the bow of the boat and is operable to permit the flap 20 to pivot downward from frame 10 into the water, providing a ramp or wedge deflecting water away from the boat hull and creating a low pressure area for draining. The flap 20 is open-sided, such that there are no walls extending perpendicularly or vertically from the boat-facing side thereof. This is in contrast to Elvstrom-type bailers which include walls extending from the edges of the boat-facing side of the flap.

Figure 10:
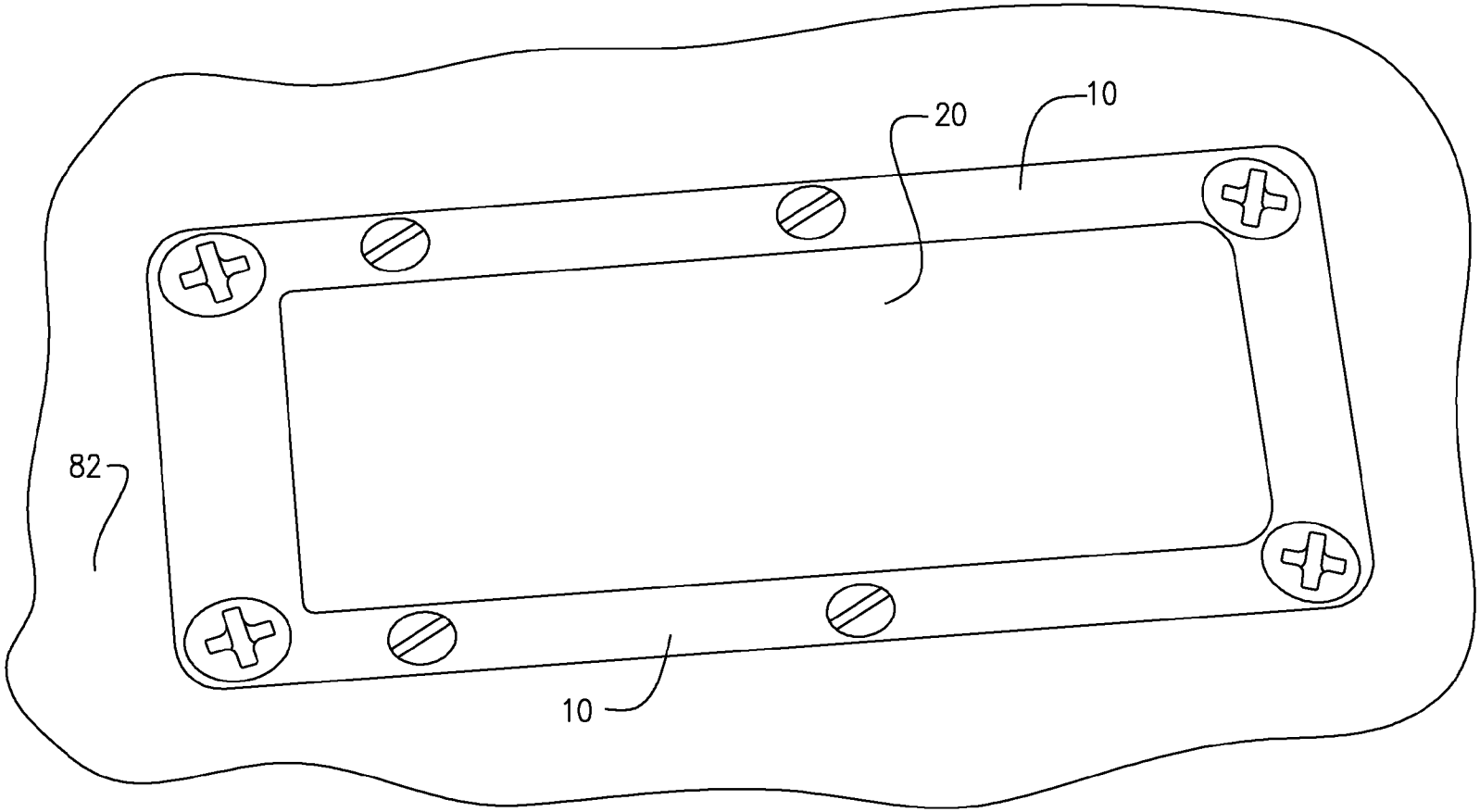
FIG. 10 is a bottom view of a flap and frame of a bailer installed in a boat, viewed from the outside of the hull, in accordance with one aspect of the present disclosure.

In accordance with the present disclosure, when flap 20 is in the open position, water from the boat can drain through opening 13 over the rear and sides of the flap 20. With further reference to FIG. 10, in one embodiment the water-facing side of the flap 20 comprises essentially a flat plate which forms a flush engagement with the frame, and essentially the hull of the boat, when retracted (closed). In one embodiment the flap 20 includes a rib or web 22 extending vertically from the boat-facing side of the flap 20, the web 22 having a slot 24 and detents 26. The slot 24 is configured to accommodate a drive pin (shown in FIG. 1) operably connected to the handle 30. The action of the handle-actuated drive pin 40 sliding in the slot 24 opens and closes the flap 20 of the bailer 2.

Figure 5:
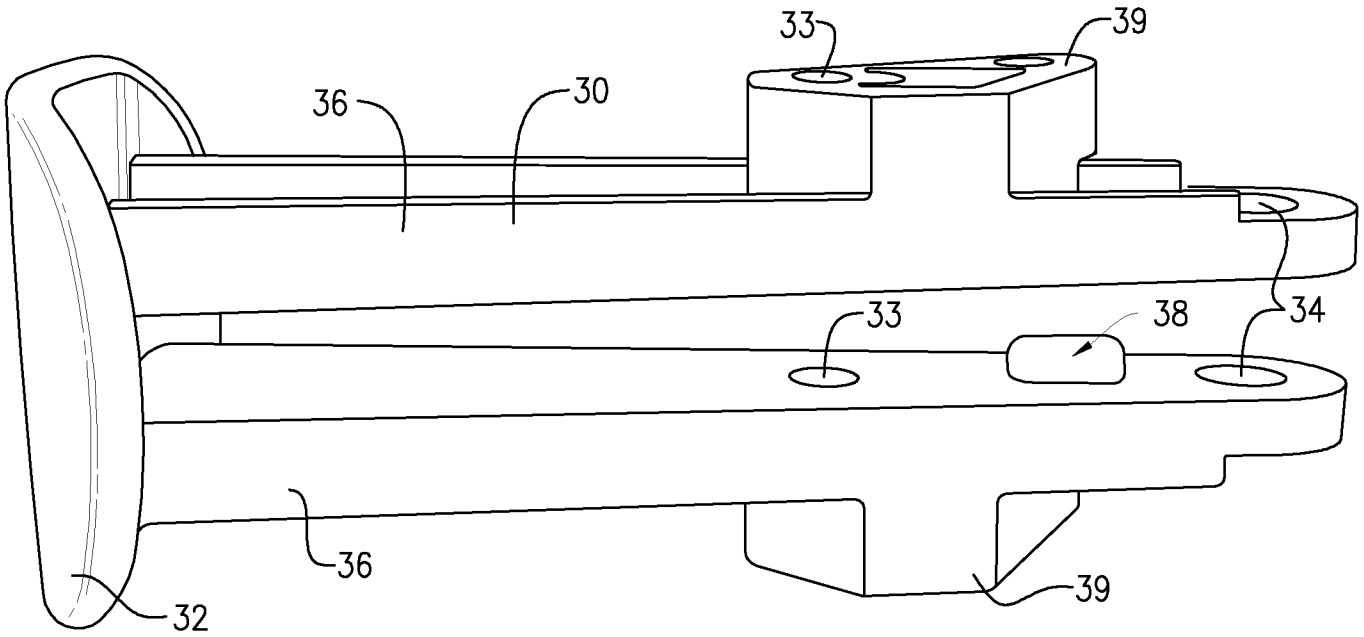
FIG. 5 is front view of the handle of FIG. 4 in accordance with an aspect of the present disclosure.

With further reference to FIG. 5, detents 26 accommodate a tab 38 formed on handle 30, which may engage the detents 26 at various positions to provide indexing for the desired position of the flap 20. While activating the handle 30, a user can feel it snap into the index positions and know how far the bailer flap 20 is open without looking at it, which can be difficult when the bailer is mounted in the footwell of a kayak. Nevertheless, the position of the handle 30 provides a visual cue notifying the user instantly how far open or closed the bailer is. In one embodiment, for example, the handle 30 may be oriented vertical with respect to the frame 10 at the half open position and proportionally more open or closed as the handle 30 is adjusted in either direction from vertical. With further reference to FIG. 1, in one embodiment, the bailer handle support 14 may include indicia 17 such as numbers, with or without lines, positioned along a surface thereof to provide a visual cue to a user of the position of the flap 20.

Figure 4:
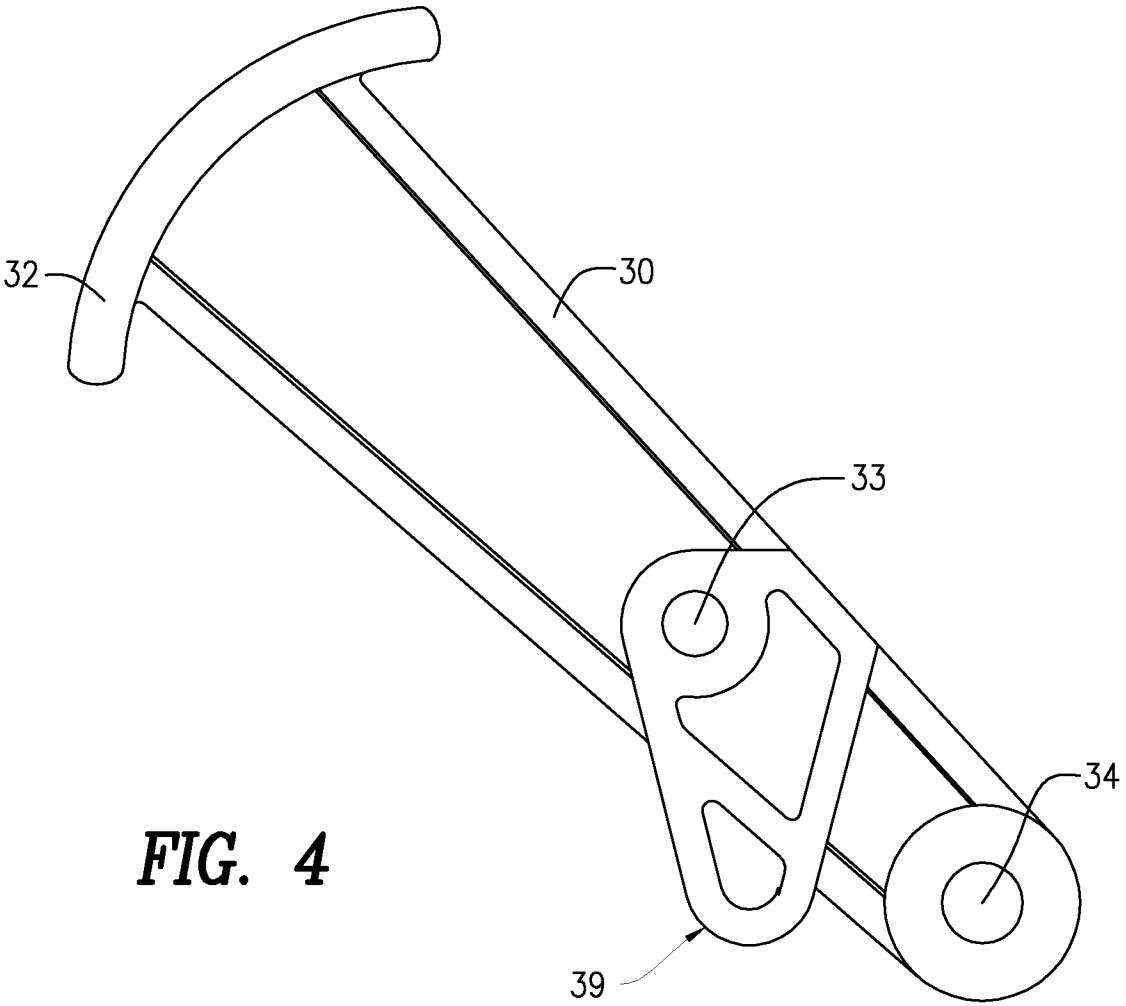
FIG. 4 is side view of a handle of a bailer in accordance with an aspect of the present disclosure.

With further reference to FIGS. 4 and 5, handle 30 is pivotably connected to frame 10 at a point between the ends of the handle 30, such as at opening 33, and is operable to move the flap 20 between open and closed positions, pivoting on support 14 of the frame 10. A grip 32 may be present on one end of the handle 30 and can be operated either with the hand or the foot. The grip may be any desired shape that facilitates ease of use for a user. Foot operation of the bailer 2 is convenient for canoes and kayaks so that the user can control the bailer 2 without taking their hands off the paddle. Accordingly, the grip may be T-shaped, spherical, or the like so it may be easily manipulated using the feet. The grip may be formed of or have a covering formed of resilient material such as rubber or the like, to provide cushion and reduce the likelihood of injury to a user's feet. The surface of the grip 32 may be roughened to enhance friction and grip.

On the end opposite the grip is a connection for drive pin 40. The handle 30 may include connecting bars 36, so that pins spanning between the bars 36 can engage with frame 10 via openings 33 and slot 24 on the flap web 22 via openings 34 via pin 40.

A tab 38 may be located on the inside of at least one of the connecting bars 36 to engage the detents 26 on the bailer flap web 22 to provide positive indexing in the desired positions. The number of detents and/or indexing positions can be varied depending on the needs of the user. In one embodiment the bailer includes five index positions: one fully closed, one fully open and three intermediate positions. It will be apparent to the skilled artisan a greater or lesser number of detents and/or indexing positions may be employed.

Figure 6:
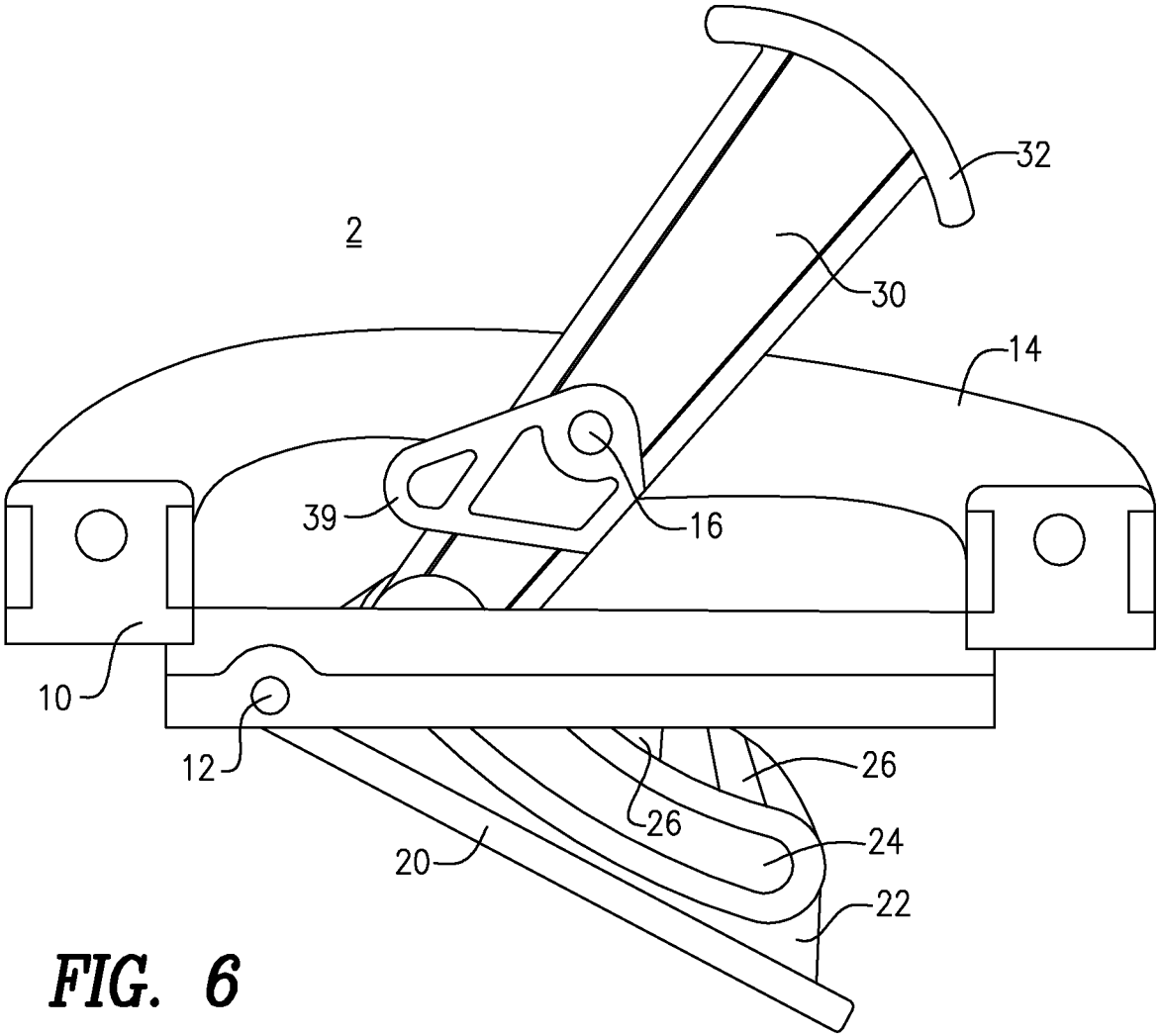
FIG. 6 is a side view of a bailer in the open position in accordance with one aspect of the present disclosure.
Figure 7:
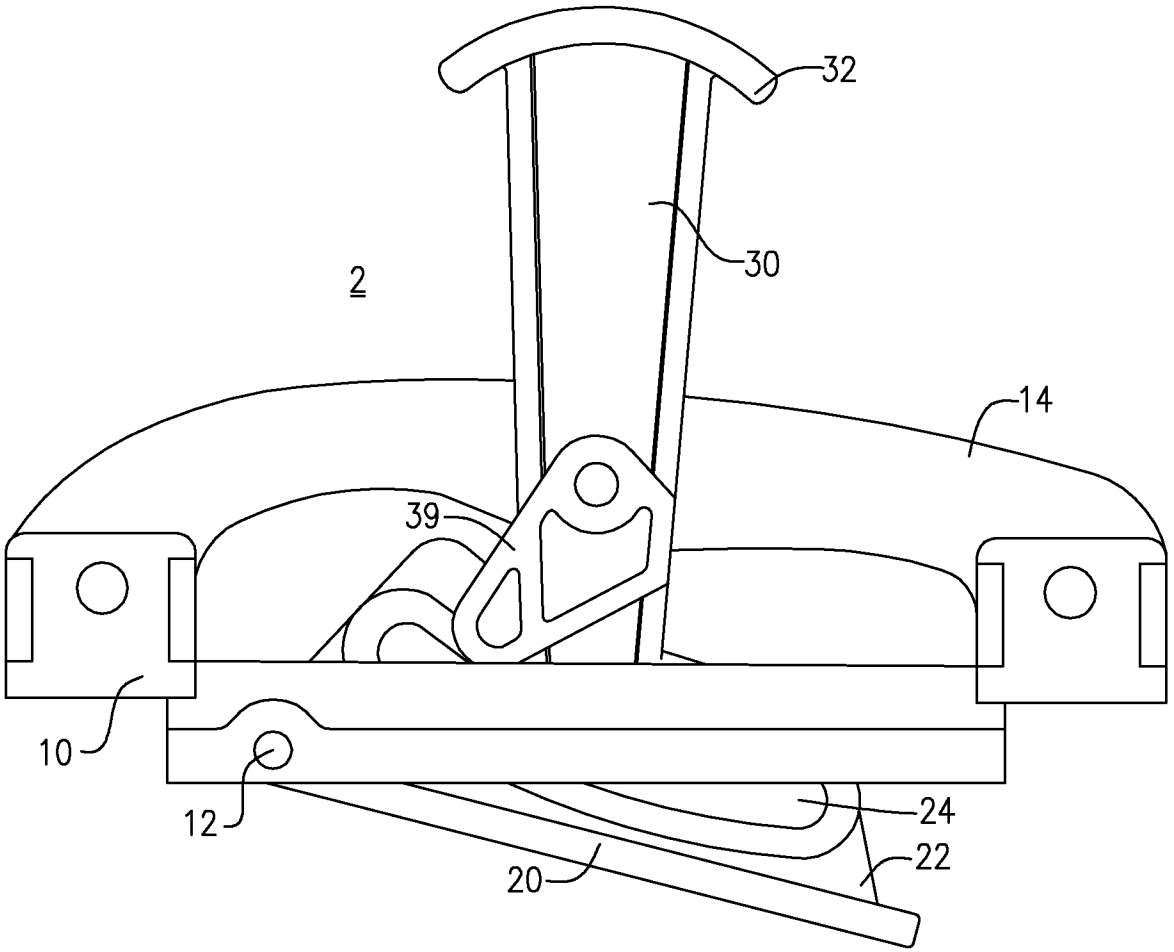
FIG. 7 is a side view of a bailer in the half open position in accordance with one aspect of the present disclosure.
Figure 8:
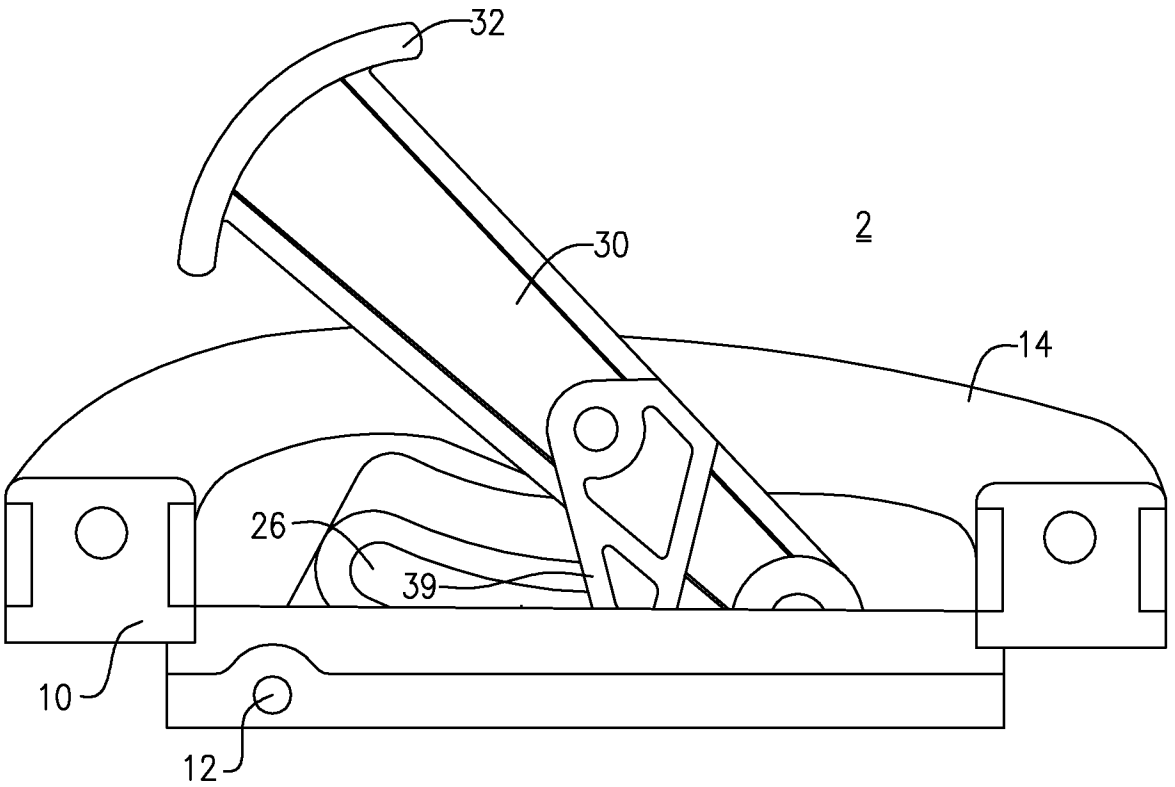
FIG. 8 is a side view of a bailer in closed open position in accordance with one aspect of the present disclosure.

With further reference to FIGS. 6-8, cam arms 39 may be located on the outside of each connecting bar 36 which are operable to contact and exert pressure on the bailer frame 10 and tighten the bailer flap 20 against the gasket as the flap 20 is closed, as can be seen from FIGS. 6-8. FIGS. 6-8 show the bailer flap in the full open position, half open position, and closed position, respectively.

Figure 9:
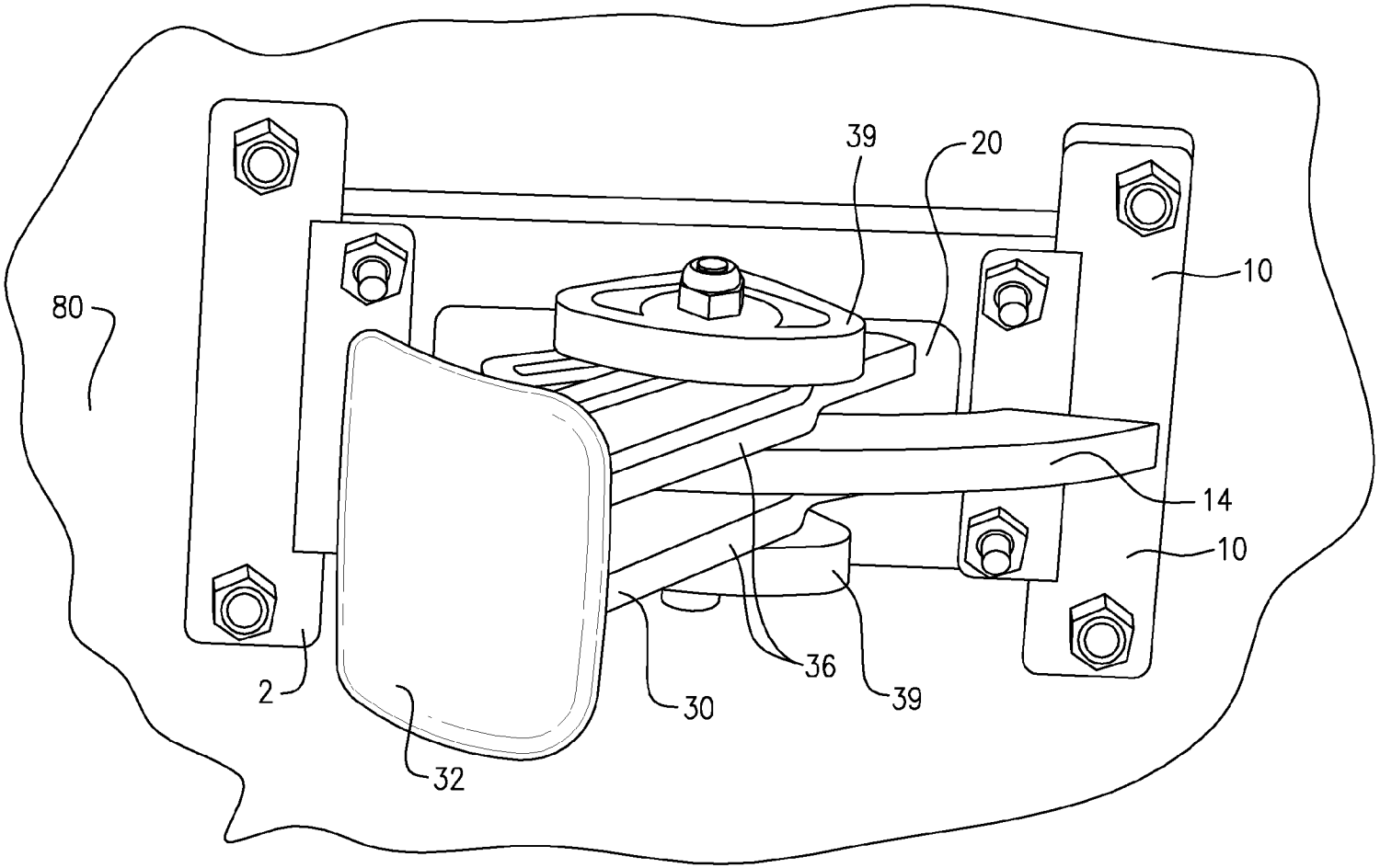
FIG. 9 is top view of a bailer installed in a boat, viewed from the inside of the hull, in accordance with one aspect of the present disclosure.

Now referring to FIGS. 9-10, embodiments of a bailer in accordance with the present disclosure are depicted installed in a boat hull. FIG. 9 depicts the inside surface 80 of a boat hull to which a bailer 2 is mounted using screws and bolts to secure the bailer 2 to the boat hull. FIG. 10 depicts the outside surface 82 of a boat hull and the flap 20 in a closed position against frame 10.

Figure 11:
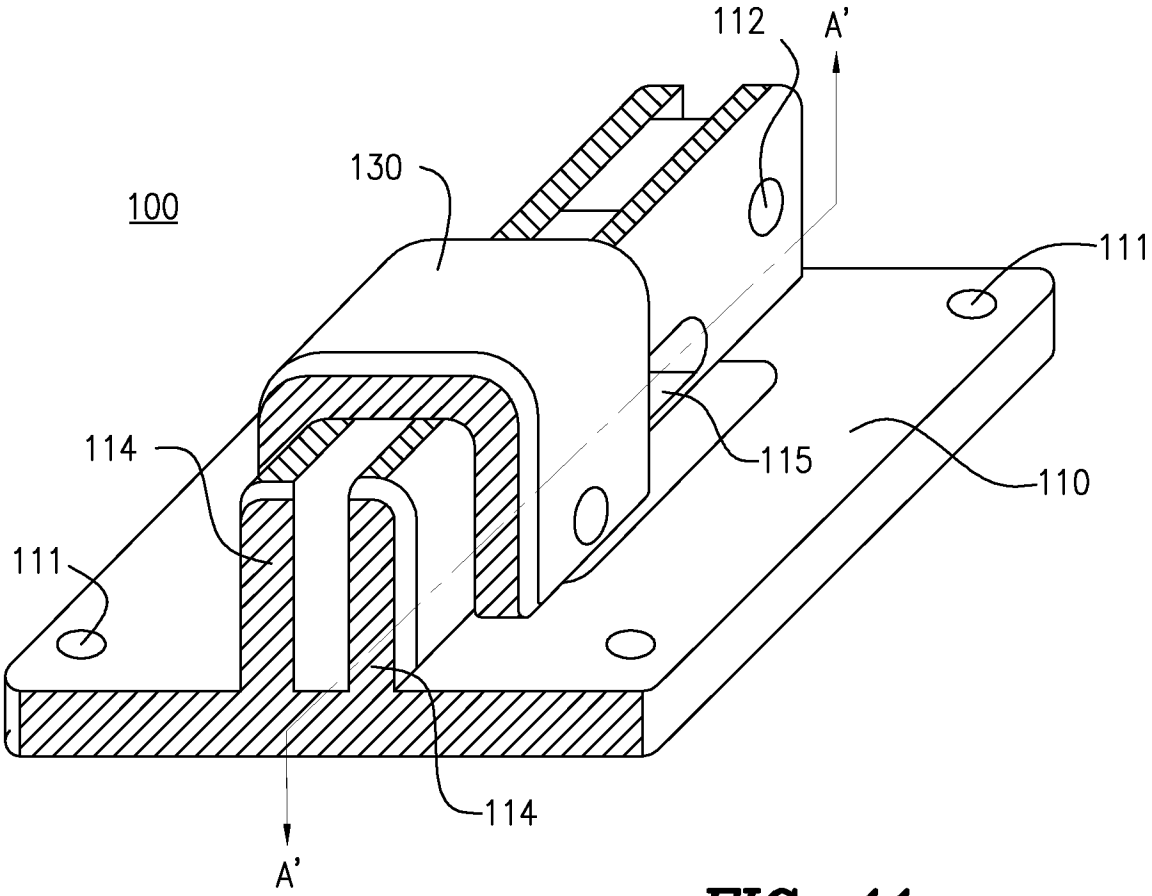
FIG. 11 is a is a perspective view of a frame of a bailer in accordance with another aspect of the present disclosure.
Figure 11A:
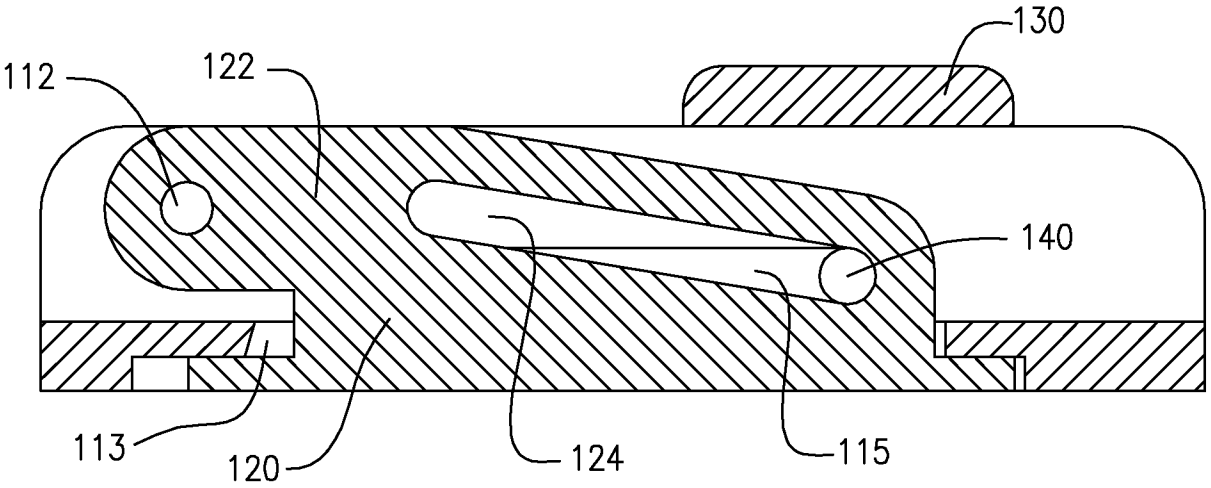
FIG. 11A is a cross-sectional view of the bailer of FIG. 11 taken through line A-A' in accordance with one aspect of the present disclosure.
Figure 12A:
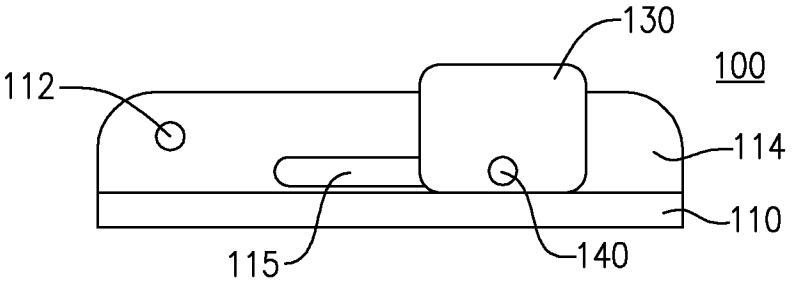
FIG. 12A is a side view of a bailer in a closed position in accordance with one aspect of the present disclosure.
Figure 12B:
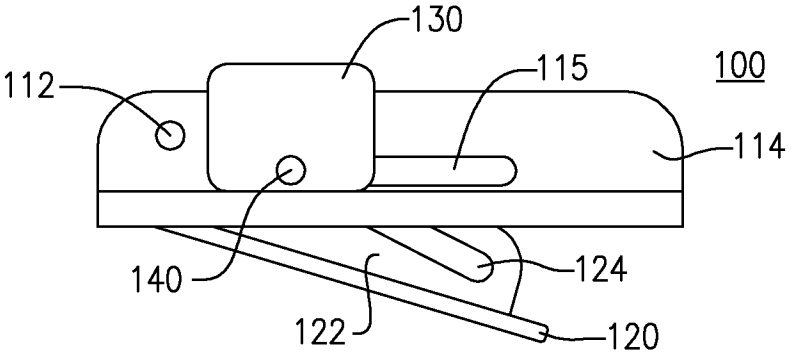
FIG. 12B is a side view of the bailer of FIG. 12A in an open position in accordance with one aspect of the present disclosure.
Figure 12C:
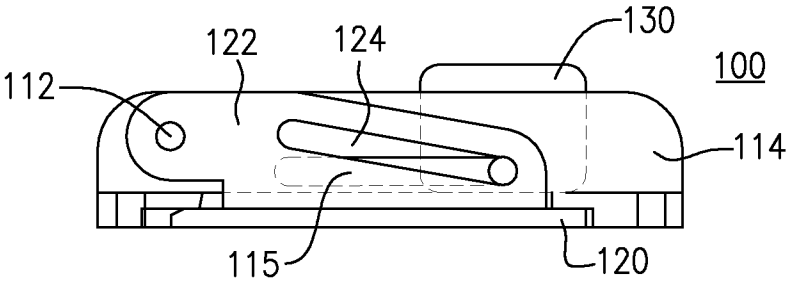
FIG. 12C is a side phantom view of the bailer of FIG. 12A in a closed position in accordance with one aspect of the present disclosure.
Figure 12D:
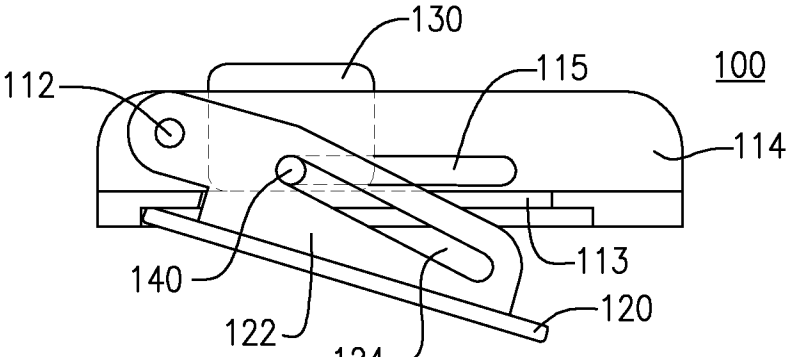
FIG. 12D is a side phantom view of the bailer of FIG. 12A in an open position in accordance with one aspect of the present disclosure.

Now referring to FIGS. 11-12D, in another embodiment a bailer 100 includes a frame 110, flap 120 and sliding handle 130.

Frame 110 is configured to mount in an aperture formed in the bottom of a watercraft, such as a kayak, employing any suitable mounting means such as but not limited to screws, rivets, bolts, and/or adhesive. The frame 10 may include apertures 111 formed therein for receiving mounting means. The frame 110 may include a hinge 112 disposed proximate an opening 113, the hinge 112 configured to pivotably engage flap 120 such as via a hinge pin or the like. The pivotable engagement of the flap 120 to the frame 110 enables the flap 120 to pivot down and drain water from the boat. In one embodiment, a gasket (not shown) is positioned on the frame 110 around the opening 113 to provide a sealing surface against the flap 120 to prevent water from leaking into the boat when the flap is closed against the frame 110. Frame 110 may include vertical supports 114 which extend longitudinally along the frame 110. Supports 114 include an aperture 115 formed longitudinally along a portion of the length of the supports. Apertures 115 in supports 114 are configured to receive a pin which serves as a slidable connection to a pin 140 of sliding handle 130 as described in further detail hereinbelow.

Sliding handle 130 is generally U-shaped and configured to slidably engage supports 114 via pin 140.

Flap 120 is pivotably connected to frame 110 at a hinge 112. In one embodiment the flap 120 includes a rib or web 122 extending vertically from the boat-facing side of the flap 120, the web 122 having a slot 124. The slot 124 is configured to accommodate a pin 140 operably connected to the handle 130. Handle 130 is slidable along the supports 114, fore and aft. The action of the pin 140 sliding in the slot 124 as the handle 130 moves fore and aft opens and closes the flap 120 of the bailer 100. When the bailer 100 is installed in the boat, the hinge 112 is positioned proximal the bow of the boat and is operable to permit the flap 120 to pivot downward from frame 110 into the water, providing a ramp or wedge deflecting water away from the boat hull and creating a low pressure area for draining. When flap 120 is in the open position, water from the boat can drain through opening 113 over the rear and sides of the flap 120. In one embodiment the water-facing side of the flap 120 comprises essentially a flat plate which forms a flush engagement with the frame 110, and essentially the hull of the boat, when retracted (closed).

Figure 13:
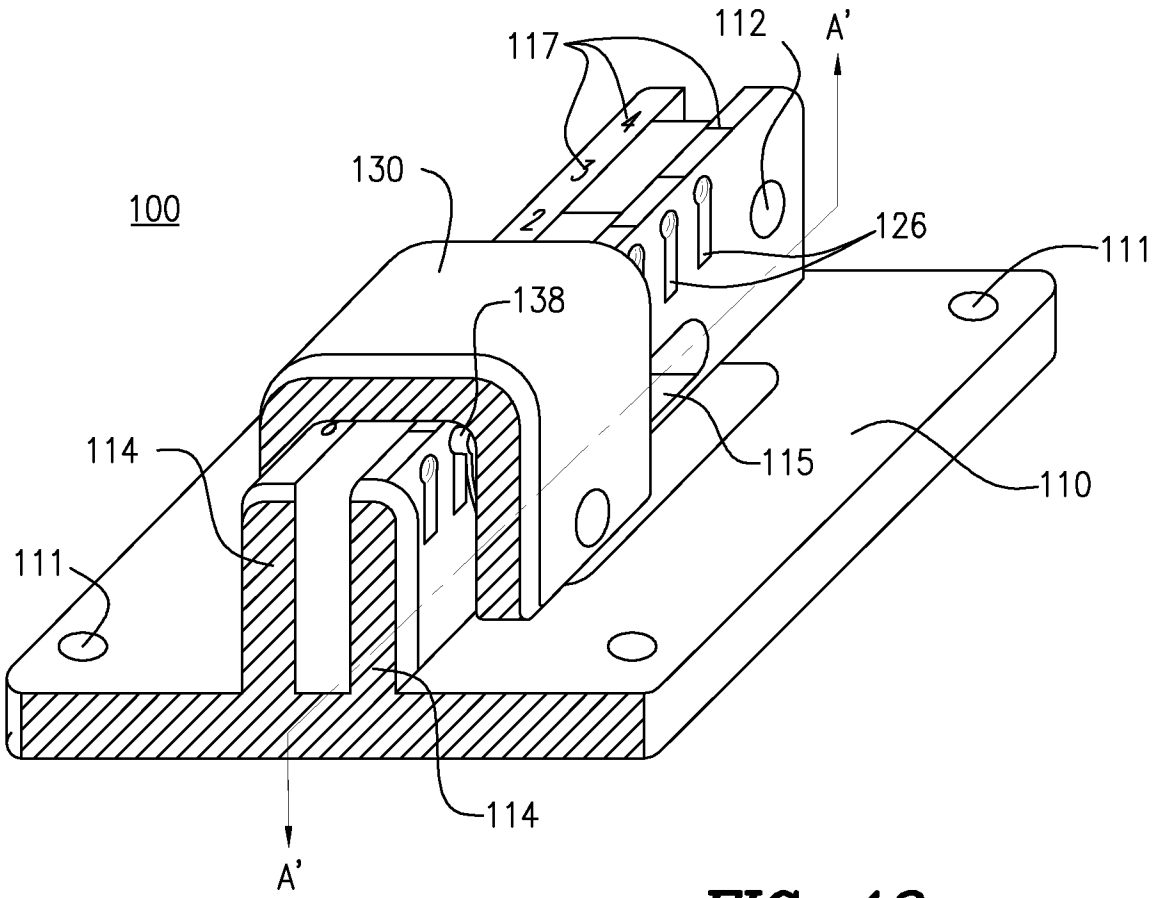
FIG. 13 is a further embodiment of a bailer in accordance with the present disclosure.

Now referring to FIG. 13, bailer 100 may include detents 126 and tab 138 to provide tactile feedback to a user to indicate the position of the bailer flap 120. Bailer 100 may include indicia 117 to provide a visual cue as to the position of flap 120. Tab 138 may be a resilient piece extending from handle 130, a separate piece that attachable to the handle 130 such as by a screw or the like, a spring-loaded tab connected to the slider, etc. As with other embodiments disclosed herein, the detents 126 and tab 138 also serve to secure the bailer flap 120 in a desired position.

It will be apparent to the skilled artisan that the location of tabs and detents in the foregoing embodiments may be switched, so that a detent is located on the handle and the tab may be positioned on a support or web.

Many advantages are achieved by the disclosed subject matter. The presently disclosed bailers eliminate at least one side and the vertical rear wall present in the wedge of conventional bailers. This allows a significantly larger area for water to drain from the boat. Water can drain from 100% of the back section, as well as the entire side sections.

It is recognized that in the present designs, water is free to backflow inside the boat when the bailer is open and the boat is sitting still or traveling at insufficient speed to create draining pressure. To attenuate this condition, the bailer may be in one embodiment installed in a footwell, bulkheaded cockpit, or other part of the boat that is separated from the main boat interior so that the boat will not completely fill with water and sink. This arrangement is particularly well suited to sit-on-top boats, including surf skis and one & two man outrigger canoes (OC-1/OC-2).

Another significant advantage of the presently disclosed subject bailers is that the indexing feature permits the flap to easily be opened only partially. The full draining area is not needed in all conditions. When minimal water is entering the boat, a fully open bailer creates more drag and slows the boat more than necessary. By opening the bailer partially, the drag is decreased while adequate draining is still achieved for the lighter conditions.

The disclosed bailers include a handle which sets the opening of the bailer. The position of the handle can be seen visually to give an indication of how far the bailer is open. Additionally, the bailer positions may be indexed. In some embodiments the bailer "clicks" or provides tactile feedback at multiple positions due to engagement with a detent. Since the bailers disclosed herein do not include a gate that needs to swing open, they can function at any position (including 25% open or other setting less than 50% open), whereas the prior art Elvstrom-type bailers must be opened at least 50% before the gate will swing open and allow draining.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A bailer for a kayak or canoe comprising a frame comprising an opening formed therein and at least one support extending from the frame, an open-sided flap comprising a first side configured to face an interior of the kayak or canoe and having no walls extending perpendicularly or vertically from a periphery thereof, a second, opposite side configured to face away from the kayak or canoe and an end pivotably connected to the frame, the flap operable to move pivotably from a closed position covering the opening to an open position away from the opening, and a handle pivotably connected to the support and operable to move the flap between open and closed positions.

2. The bailer according to claim 1 wherein the frame is configured to mount in an aperture formed in the bottom of a kayak or canoe.

3. The bailer according to claim 1, wherein the handle is pivotably connected to the support at a point between the ends of the handle.

4. The bailer according to claim 1, wherein the flap comprises a web extending vertically therefrom, the web comprising a slot formed therein and at least one detent formed on a side of the web.

5. The bailer according to claim 4, wherein the second, opposite side is substantially flat.

6. The bailer according to claim 4, wherein the slot is configured to accommodate a drive pin operably connected to an end of the handle, wherein the drive pin is slidably engaged in the slot.

7. The bailer according to claim 6 wherein the handle comprises opposing connecting bars configured to pivotably engage the support extending from the frame, and the drive pin spanning between the connecting bars.

8. The bailer according to claim 7 further comprising at least one tab positioned on an inside surface of at least one of the connecting bars and operable to engage the at least one detent.

9. The bailer according to claim 8 further comprising at least one cam arm positioned on an outside surface of at least one connecting bar, wherein the cam arm is operable to contact the frame.

10. A bailer for a kayak or canoe comprising a frame comprising an opening formed therein and at least one support extending vertically from a first side of the frame and extending longitudinally along the frame, the at least one support comprising an aperture formed longitudinally along a portion of the length of the at least one support, an open-sided flap comprising a first side configured to face an interior of the kayak or canoe and having no walls extending perpendicularly or vertically from a periphery thereof, a second, opposite side configured to face away from the kayak or canoe and an end pivotably connected to the frame, the flap operable to move pivotably from a closed position covering the opening to an open position away from the opening, and a handle comprising a pin slidably engaged to the aperture of the support and operable to slide longitudinally along the at least one support and move the flap between open and closed positions.

11. The bailer according to claim 10 wherein the handle is generally U-shaped.

12. The bailer according to claim 11 wherein the first side comprises a web extending vertically therefrom, the web comprising a slot configured to accommodate the pin of the handle.

13. The bailer according to claim 1 wherein the position of the handle is operable to provide to a user a visual cue identifying the position of the bailer flap.

14. The bailer according to claim 1 wherein the handle is operable to provide to a user a tactile indicator of the position of the bailer flap.

15. The bailer according to claim 1 comprising indicia positioned on the surface of the frame operable to provide to a user a visual cue identifying the position of the bailer flap.

16. The bailer according to claim 1 wherein the handle comprises a grip extending from one end of the handle.

17. A kayak or canoe having a bailer according to claim 1 mounted in a hull thereof.

18. A kayak or canoe having a bailer according to claim 1 formed in a footwell thereof.

19. The bailer according to claim 10 wherein the position of the handle is operable to provide to a user a visual cue identifying the position of the bailer flap.

20. The bailer according to claim 10 wherein the handle is operable to provide to a user a tactile indicator of the position of the bailer flap.

21. The bailer according to claim 10 comprising indicia operable to provide to a user a visual cue identifying the position of the bailer flap.

22. The bailer according to claim 10 wherein either the handle or the support comprises a tab and either the handle or the support comprises at least one detent operable to engage the tab.

23. A bailer for a kayak or canoe comprising a frame comprising an opening formed therein and a support extending therefrom, a flap comprising a first side configured to face an interior of the kayak or canoe and having no walls extending perpendicularly or vertically from a periphery thereof, a second, opposite side configured to face away from the kayak or canoe and an end pivotably connected to the frame, the flap operable to move pivotably from a closed position covering the opening to an open position away from the opening, and a handle operably connected to the support and operable to activate opening and closing of the flap, wherein the position of the handle is operable to provide to a user at least one of a visual cue identifying the position of the bailer flap and a tactile indicator of the position of the bailer flap.

24. The bailer according to claim 23 comprising indicia operable to provide to a user a visual cue identifying the position of the bailer flap.

25. The bailer according to claim 23 wherein the tactile indicator comprises a detent and a complementary tab operable to engage the detent.

* * * * *